US006795675B2

(12) United States Patent
Fujita

(10) Patent No.: US 6,795,675 B2
(45) Date of Patent: Sep. 21, 2004

(54) DEVELOPING-CARRYING MEMBER, AND DEVELOPING APPARATUS AND IMAGE FORMING APPARATUS INCLUDING THE MEMBER

(75) Inventor: Hideki Fujita, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 10/080,670

(22) Filed: Feb. 25, 2002

(65) Prior Publication Data

US 2002/0168201 A1 Nov. 14, 2002

(30) Foreign Application Priority Data

Feb. 26, 2001 (JP) ..... 2001-050219

(51) Int. Cl.[7] ..... G03G 15/08
(52) U.S. Cl. ..... 399/286
(58) Field of Search ..... 399/286, 279, 399/265

(56) References Cited

U.S. PATENT DOCUMENTS 4,526,130 A 7/1985 Fukuda et al.
4,774,543 A 9/1988 Yoshikawa et al.
5,286,917 A * 2/1994 Unno et al. ..... 399/279
5,697,029 A * 12/1997 Saitoh et al. ..... 399/286
6,094,554 A * 7/2000 Ichikawa et al. ..... 399/279
6,201,942 B1 3/2001 Honda et al. ..... 399/286

FOREIGN PATENT DOCUMENTS

| | | |
|---|---|---|
| JP | 55-26526 | 2/1980 |
| JP | 58-132768 | 8/1982 |
| JP | 3-41485 | 2/1991 |
| JP | 6-230676 | 8/1994 |
| JP | 2000-284586 | 10/2000 |

* cited by examiner

*Primary Examiner*—Susan S. Y. Lee
(74) *Attorney, Agent, or Firm*—Fitzpatrick, Cella, Harper & Scinto

(57) ABSTRACT

A developer-carrying member having a rigid electroplating surface layer free from locally abnormal metal deposition and exhibiting a high-accuracy surface roughness is provided so as to be free from occurrence of tailing of images even in high-speed image formation. The developer-carrying member has a substrate, and laminate coating layers successively formed thereon including an intermediate layer, a joint layer and a rigid electroplating layer, and is characterized in that the joint layer inserted between the intermediate layer and the electroplating layer for improving the adhesion therebetween having a substantially non-magnetic material as represented by a volume susceptibility of at most 1 $\mu$H/m.

21 Claims, 4 Drawing Sheets

DEVELOPING-CARRYING MEMBER, AND DEVELOPING APPARATUS AND IMAGE FORMING APPARATUS INCLUDING THE MEMBER

FIELD OF THE INVENTION AND RELATED ART

The present invention relates to a developer-carrying member, a developing apparatus and an image forming apparatus used for a copying machine, a laser beam printer, a facsimile apparatus, a printing apparatus, etc., according to electrophotography.

Hitherto, a developer-carrying member has been provided with a roughened uneven surface for conveying the developer. As old examples, Japanese Laid-Open Patent Application (JP-A) 54-79043 has disclosed one provided with knurled grooves or ridges for principally the two-component developing scheme, and JP-A 55-26526 has disclosed one provided with a roughened surface for principally the mono-component developing scheme.

Particularly, for providing a developer-carrying member having a roughened surface, it has been proposed to coat a substrate with a surface-coating layer of a relatively high hardness material for preventing the wearing of surface unevennesses during long-term use. For example, JP-A 58-132768 has disclosed a developer-carrying member comprising an aluminum substrate surface-coated with a layer of a nitride such as TiN or CrN, a carbide such as TiC or $B_4C$, or Ni—P plating; JP-A 6-230676 has disclosed a developer-carrying member comprising a substrate of aluminum, brass or stainless steel surface-coated with Cr plating, anodized aluminum film layer, Ni—P plating or nitriding layer; and JP-A 3-41485 has disclosed a developer-carrying member comprising a substrate of aluminum, stainless steel, etc., surface-coated with a plating layer of Cr, Cu—Cr, Ni—Cr, Cu—Ni—Cr, Ni—Cu—Ni—Ca, etc.

Such known wear-resistant surface coating layers include a highly wear-resistant layer, such as an electroless Ni—P plating layer which can be provided with a Vickers hardness of 900 or higher through a heat treatment at 300–500° C. (JP-A 58-132768). However, such a heat treatment results in a substantial lowering in satisfactory product yield. This is because the substrate causes a thermal deformation of several tens of $\mu$m or larger in a direction vertical to the extension direction thereof, so that the spacing between the electrostatic image-bearing member and the developer-carrying member is locally fluctuated to cause image irregularity in the product toner image. Such an image irregularity seriously obstructs high-quality toner image formation.

A surface-coating layer formed by electroplating is rigid and excellent in wear resistance, and is moreover advantageous that it does not require a high-temperature heating treatment.

However, the formation of a surface-coating layer by electroplating is also accompanied with a difficulty as follows. In the electroplating, a metal is precipitated from a plating solution and deposited on a substrate in proportion to a density of lines of electric force, but a substrate surface is generally accompanied with minute projections and cracks. The lines of electric force tend to be concentrated toward the top of each projection or the edges of each crack. Accordingly, the metal is abnormally deposited at such sites, thus making it difficult to provide a rigid plating layer having a prescribed surface roughness. For overcoming such a difficulty, JP-A 2000-284586 has proposed a developer-carrying member which has been formed by first forming an electroless plating intermediate layer on a substrate, and forming successively thereon an Ni joint layer and a rigid electroplating layer.

In recent years, along with a desire for a higher-speed image forming apparatus, it has been demanded to achieve a higher-speed image formation while retaining a basic apparatus organization. In case where a developer-carrying member having a laminate structure as described above is incorporated in such a high-speed image forming apparatus, there has been observed a phenomenon that when an objective image like a lateral line as shown in FIG. 3A is reproduced, the resultant image is accompanied with trailing ears as shown in FIG. 3B. The phenomenon may be referred to as "tailing (of images)" hereinafter.

SUMMARY OF THE INVENTION

Accordingly, an object of the present invention is to provide a developer-carrying member capable of providing images free from such tailing even when incorporated in a high-speed image forming apparatus.

Further objects of the present invention are to provide a developing apparatus and an image forming apparatus using such a developer-carrying member and capable of forming good toner images.

According to the present invention, there is provided a developer-carrying member for carrying and conveying thereon a developer, having a laminate structure including successively a substrate having a surface roughness, an intermediate layer having a surface roughness smaller than that of the substrate, a joint layer and an electroplating layer, wherein the joint layer comprises a material having a volume susceptibility of at most 1.

As used herein, the term "susceptibility" of a material means susceptibility per unit mass ($\chi$) expressed in centimeter, gram, second (CGS) electromagnetic units, multiplied by $10^6$, i.e., susceptibility equals $\chi \times 10^6$ CGS.

The present invention also provides:

a developing apparatus for developing an electrostatic latent image formed on an image-bearing member, the developing apparatus comprising a developer-carrying member which has a laminate structure including successively a substrate having a surface roughness, an intermediate layer having a surface roughness smaller than that of the substrate, the above-mentioned joint layer and an electroplating layer; and an image forming apparatus, comprising: an image-bearing member for forming thereon an electrostatic image thereon, and a developer-carrying member disposed opposite to the image-bearing member for carrying and conveying thereon to develop the electrostatic image, wherein the developer-carrying member has a laminate structure including successively a substrate having a surface roughness, an intermediate layer having a surface roughness smaller than that of the substrate, the above-mentioned joint layer and an electroplating layer.

The developer-carrying member of the present invention includes an intermediate layer and a rigid electroplating layer, between which is disposed a joint layer for increasing the adhesion between the two layers comprising a material which has a susceptibility of at most 1 CGS, i.e., is substantially non-magnetic. As a result, the problem of tailing can be solved. In the case of a conventional Ni plating joint layer, Ni is a ferromagnetic material having a susceptibility of 49000 CGS, which is considered to cause the tailing.

More specifically, because of the ferro-magnetism, the Ni plating joint layer affects the shapes of toner ears on the developer-carrying member surface, and long toner ears are caused to be transferred onto the electrostatic image-bearing member, thus causing the tailing of images. The tailing becomes more noticeable at a higher image forming speed. This is considered to be because the toner receives a larger mechanical stress and a larger heat of friction in proximity to the developer-carrying member surface at a higher image forming speed, so that the toner is liable to be agglomerated.

These and other objects, features and advantages of the present invention will become more apparent upon a consideration of the following description of the preferred embodiments of the present invention taken in conjunction with the accompanying drawings.

PREFERRED EMBODIMENTS OF THE INVENTION

The developer-carrying member of the present invention has a substantially non-magnetic joint layer inserted between an intermediate layer and a rigid electroplating layer, whereby the electroplating layer can be provided with a precisely controlled surface roughness without locally abnormal metal depositions, thereby obviating the tailing of images even at a high circumferential speed of 570 mm/s or higher of the developer-carrying member.

Figure 1:
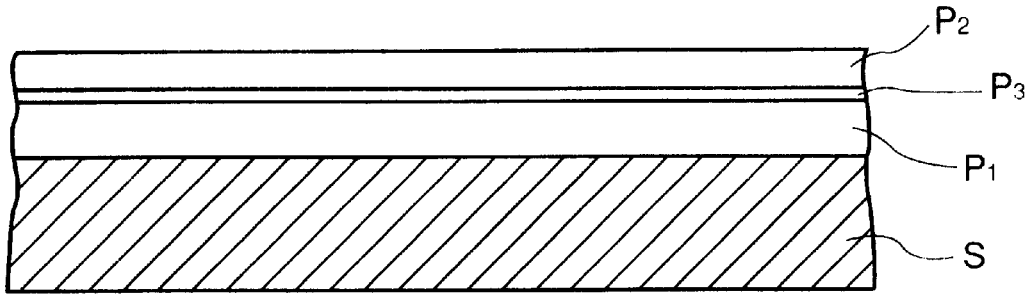
FIG. 1 is a schematic sectional view of a developer-carrying member according to the invention.

FIG. 1 is a schematic sectional view of a developer-carrying member according to the present invention, which basically includes a substrate S, and an intermediate layer P1, a joint layer P2 and a rigid electroplating layer P2 successively formed in this order on the substrate S.

Figure 2:
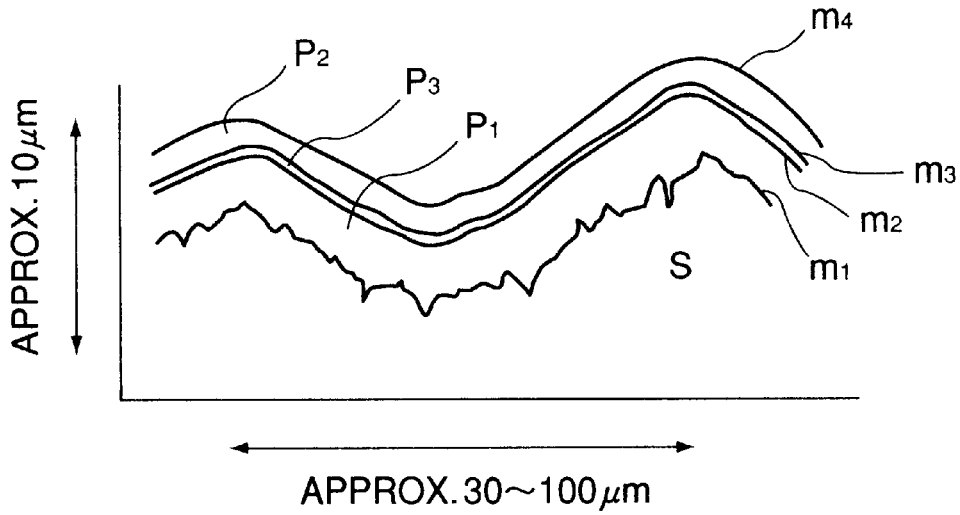
FIG. 2 is an enlarged schematic sectional view for illustrating surface roughness of component layers of a developer-carrying member according to the invention.

FIG. 2 is an enlarged schematic sectional view for illustrating surface roughnesses of the respective layers of the developer-carrying member shown in FIG. 1. Referring to FIG. 2, a curve m1 schematically represents a surface roughness distribution curve on the substrate S, which has been provided with surface unevennesses by blasting a cylindrical aluminum substrate. In addition to generally large unevennesses, a large number of minute projections and cracks are present. When such a substrate surface is directly coated with an electroplating layer, the electroplating layer is provided with enhanced steep unevennesses affected by the minute projections and cracks on the substrate surface. A developer-carrying member having such surface unevennesses exhibits a lower ability of imparting charges to the developer carried thereon, and the developer is liable to fall into and stick to the steep concavities, thus soiling the developer-carrying member.

In order to obviate the above difficulty, an intermediate layer P3 has been formed on the substrate surface, and is formed by electro-less plating in this embodiment to provide a smooth surface roughness curve m2, which has not been affected by the minute projections and cracks. Then, a joint layer P3 and an electroplating layer P2 are successively formed thereon to provide surface roughness cures m3 and m4, which are both characterized as smooth surface roughness curves because of the smoothness of the lower layers.

Next, a suitable organization of the developer-carrying member according to the present invention will be described.

The substrate S may have a shape corresponding to a form of developing apparatus in which the developer-carrying member is incorporated, such as a hollow cylinder (which also may be called a "sleeve"), a solid cylinder or a flat sheet.

The developer-carrying member may suitably have an appropriate degree of surface roughness, as represented by Rz (ten point-average surface roughness) in a range of 0.3–7 $\mu$m or Ra (arithmetic average roughness) in a range of 0.05–1.1 $\mu$m. Such a surface roughness can be provided to the developer-carrying member by applying a surface roughening treatment after forming the electroplating layer as a surface layer of the developer-carrying member according to the present invention, but in order to obviate the difficulties, such as peeling of the plating layers and attachment of blasting abrasive particles, it is preferred to apply a surface roughening treatment to the substrate surface to provide a surface roughness of Rz=ca. 1–8 $\mu$m or Ra=ca. 0.1–1.2 $\mu$m. As the surface roughening treatment, it is suitable to effect blasting with spherical particles.

The values Ra and Rz described herein for indicating surface roughness are based on values measured by using a contact-type surface roughness meter ("SURFCODER SE-3300", available from K.K. Kosaka Kenkusho) under conditions of a cut-off value of 0.8 mm, a measurement length of 2.5 mm, a feed speed of 0.1 mm/s, and a magnification of 5000.

The substrate S may preferably comprise a material such as aluminum, aluminum alloy or copper alloy. These materials are non-magnetic, and suitably used in a development system utilizing a magnetic field. Further, these metal are relatively soft as represented by a Vickers hardness of 40–180, so that they can be easily processed by the surface roughening treatment. Moreover, because of a high thermal conductivity of 150 W/m.K or higher, they are less liable to cause heat accumulation, or a lowering in size accuracy due to thermal expansion during use.

The intermediate layer P1 may suitably have a thickness of at least 3 $\mu$m so as to cover up the minute projections and cracks on the substrate surface, and also preferably have a thickness of at most 30 $\mu$m so as to form uniform plating layers thereon and cause an appropriate degree of surface unevennesses suitable for promoting the developer conveyance to appear on a surface of the plating layers.

The intermediate layer P1 may suitably comprise an electroless plating layer of Ni—P, Ni—B, Pd—P, Ni—Co—P, Ni—Fe—P, Ni—W—P, Ni—Cu—P, Co—P, etc., and particularly suitably Ni—P in view of industrial applicability and stability of product quality. In this case, it is generally preferred that the P concentration is adjusted in a range of 5–15 wt. %.

The joint layer P3 is inserted to ensure an intimate adhesion between the intermediate layer P1 and the electroplating layer P2, thereby preventing the peeling-off of the electroplating layer P2 during a long-term use of the developer-carrying member.

It is necessary that the joint layer P3 comprises a substantially non-magnetic material as represented by a volume susceptibility of at most 1 CGS. Preferred examples of the material may include: Cu and Al.

These joint layer materials are also preferred in order to effectively suppress an internally residual stress due to a difference in thermal expansion characteristics between the intermediate layer P1 and the electroplating layer P2 formed thereon.

Susceptibilities of some representative materials are shown in Table A below from which the preferability of Cu and Al would be clear.

TABLE A

| Susceptibility ($\chi \times 10^6$) | | | | |
|---|---|---|---|---|
| Al | Co | Cr | Cu | Ni |
| 0.61 | 144000 | 3.2 | −0.086 | 49000 |

The susceptibility values described herein are based on values measured by using a magnetic susceptibility meter ("MPMS", made by Nippon Quantum Design K.K.) and a disk-shaped test piece having a diameter of 1.5 mm and a thickness of 60 $\mu$m.

The joint layer P3 may suitably be formed in a thickness of 0.2–2 $\mu$m. Below 0.2 $\mu$m, it becomes difficult to exhibit the function as a joint layer, and above 2 $\mu$m, a further enhanced joining effect cannot be attained but the production time and cost are increased.

The electroplating layer P2 may suitably have a Vickers hardness Hv of at least 300, preferably at least 500. The electroplating layer P2 may suitably comprise Cr, Pt or Rh, particularly preferably Cr providing Hv of 600 or higher.

The electroplating layer P2 may preferably have a thickness of at least 0.2 $\mu$m in view of the durability and a thickness of at most 5 $\mu$m in view of good surface property which is adversely affected by too large a thickness. Further, as the smooth surface shape of the intermediate layer is caused to appear also on the electroplating layer surface, it is further preferred for the electroplating layer to have a thickness of at most 1/10 of that of the intermediate layer.

The intermediate layer P1 and the electroplating layer P2 may preferably comprise materials having susceptibilities of at most 5 CGS.

Figure 4:
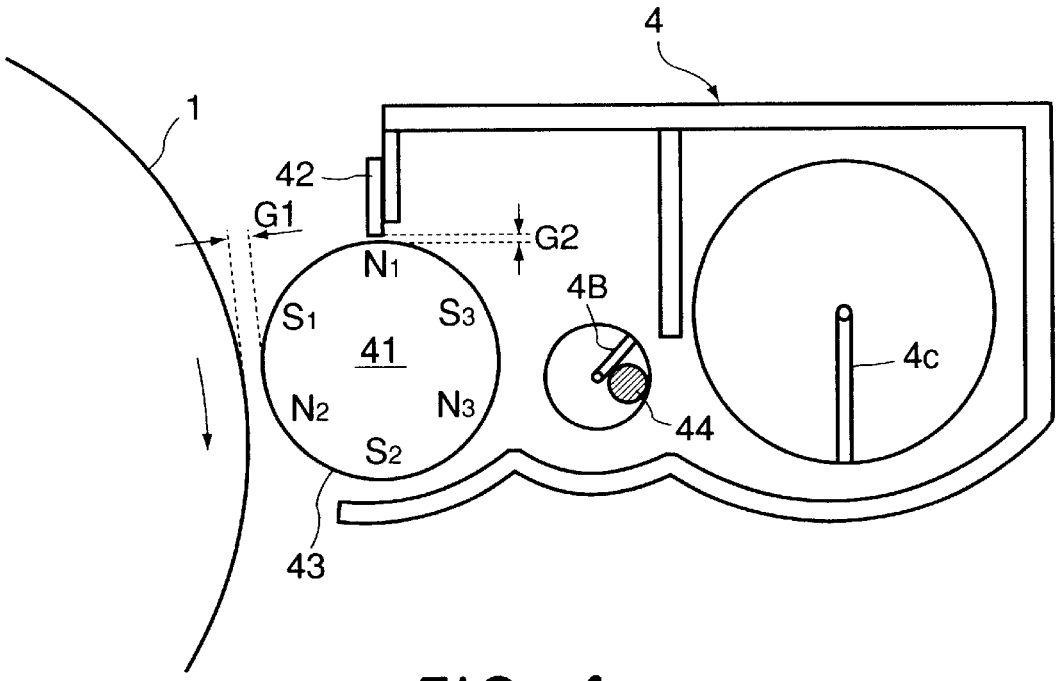
FIG. 4 is a schematic view for illustrating an organization of a developing apparatus according to the invention.

An embodiment of the developing apparatus according to the present invention is illustrated in FIG. 4. Referring to FIG. 4, a developing apparatus 4 includes a developing sleeve 43 (developer-carrying member) which has been obtained by blasting a 32.3 mm-dia. cylindrical tube of aluminum alloy (A6063 according to JIS) with spherical glass particles of 600 mesh-pass (FGB#600) and then subjecting the cylinder to three steps of plating for providing a laminate structure as shown in FIG. 1. Within the developing sleeve 43, a fixed magnet 41 having 6 magnetic poles is disposed. A toner (as a developer) is applied on the developing sleeve 43 in a thickness controlled by a magnetic blade 42 which is placed apart from the sleeve 43 with a gap of, e.g., 180 $\mu$m.

Figure 6:
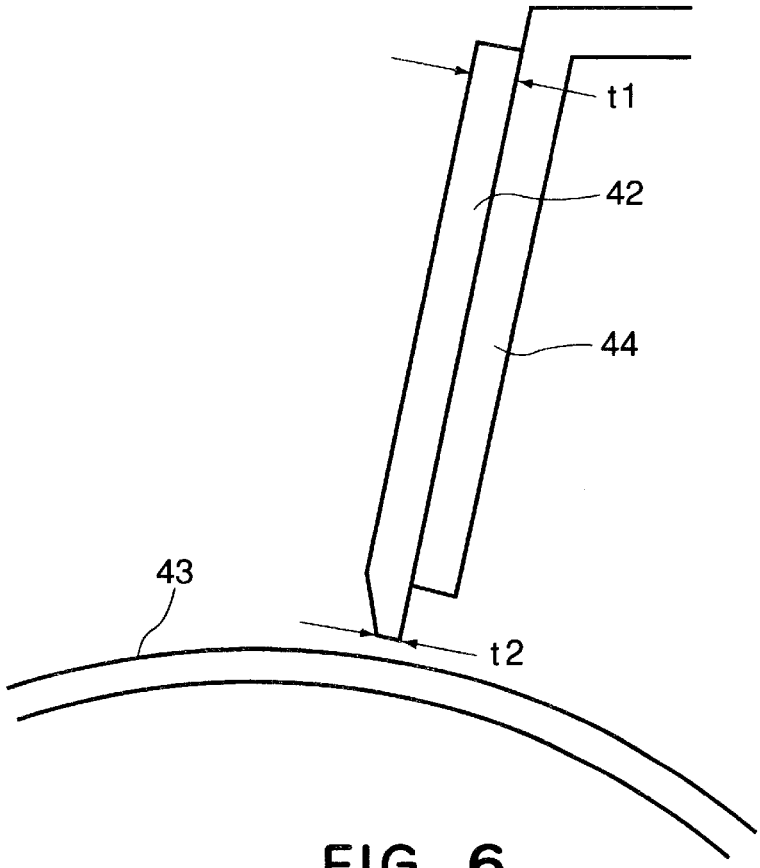
FIGS. 6 and 7 are respectively a schematic sectional view for illustrating an embodiment of a developer regulating member.
Figure 7:
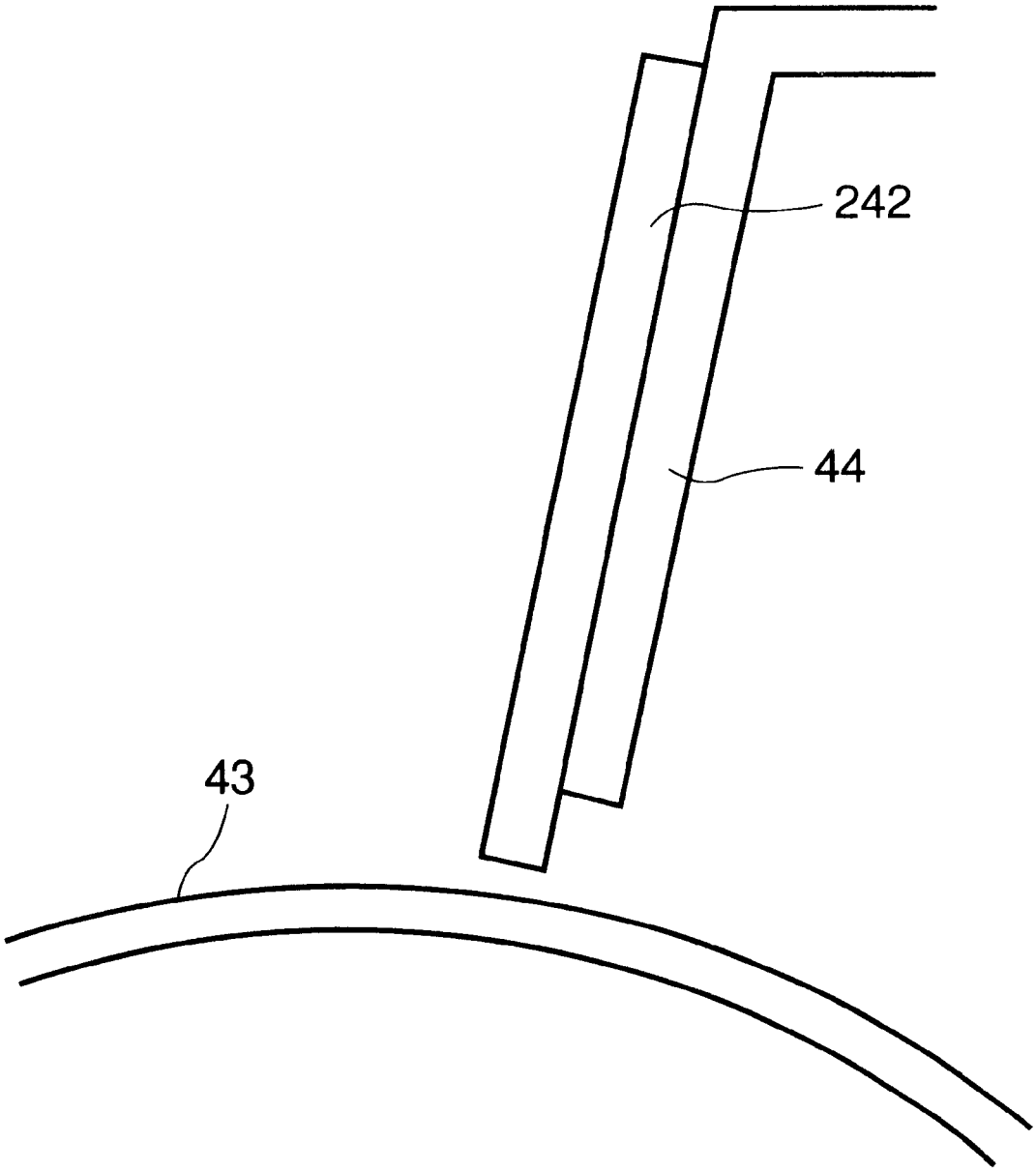

If the magnetic blade 42 made of, e.g., SPCC (i.e., cold-rolled steel sheet (JIS G3141), is in a form of a sheet provided with a tapered tip portion directed to the developing sleeve 43 as illustrated in FIG. 6, a magnetic field formed between the magnetic blade and the developing sleeve is concentrated to a narrower region than the case of using a mere flat sheet member 242 as shown in FIG. 7, thereby enhancing the thin toner layer-forming performance. As a result, a stronger toner triboelectrification ability is developed to provide a sufficient toner charge. In a specific embodiment, the magnetic blade 42 is formed in a sheet member having a thickness t1 of 1.6 mm at its screwed root portion and a thickness t2 of 0.3 mm at its very tip portion as shown in FIG. 6.

The developing apparatus 4 is further equipped with a first stirring bar 4B and a second stirring bar 4C for stirring the toner, and a toner amount detection sensor (piezoelectric device) 44. The 6 magnetic poles of the fixed magnet 41 disposed within the developing sleeve 43 exhibit, e.g., the following magnetic field pattern.

TABLE 1

| Pole | Magnetic force (G) | Angle (deg.) |
|---|---|---|
| N1 | 1000 | 0 |
| N2 | 1000 | 120 |
| N3 | 600 | 220 |
| S1 | 900 | 60 |
| S2 | 500 | 175 |
| S3 | 700 | 270 |

Figure 5:
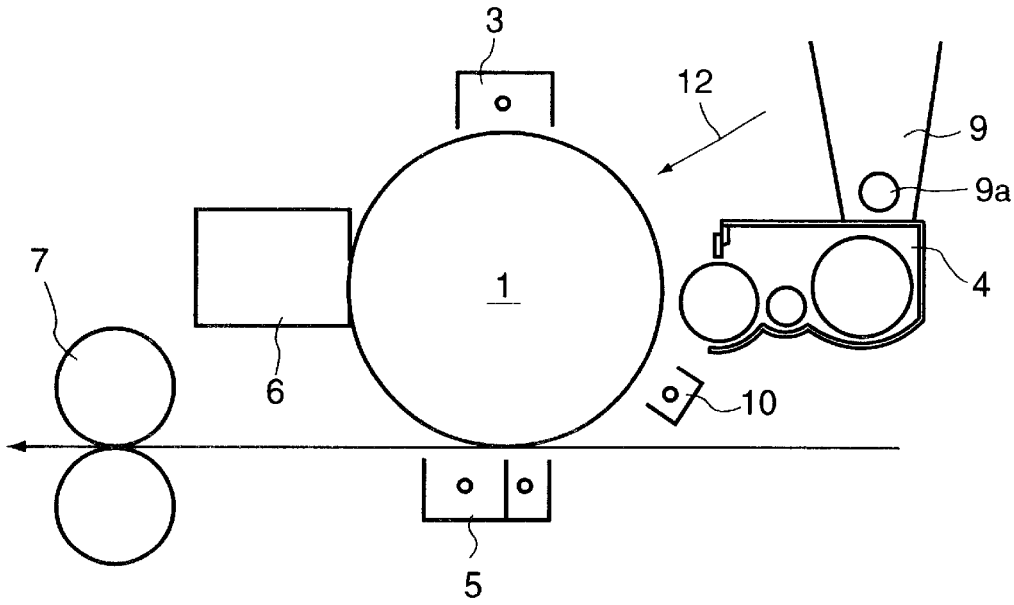
FIG. 5 is a schematic view for illustrating an organization of an image forming apparatus according to the invention.

FIG. 5 illustrates an embodiment of the image forming apparatus according to the invention.

Referring to FIG. 5, the image forming apparatus includes an a-Si (amorphous-silicon) photosensitive drum 1 of 108 mm in diameter, which is rotated at a process speed of 450 mm/sec for providing monochromatic copies of 85 A4-size sheets/min. An a-Si photoconductor has a dielectric constant of ca. 10 larger than an organic photoconductor (OPC) and a relatively low potential so that it is difficult to attain a sufficient latent image potential. On the other hand, an a-Si photosensitive member has a high durability providing a life of more than $3\times10^6$ sheets, so that it is suited for a high-speed image forming machine.

In this embodiment, the photosensitive member 1 is uniformly charged to, e.g., +340 volts and exposed to image light 12 at a resolution of 600 dpi. The image light 12 having a wavelength of, e.g., 680 nm is emitted from a semiconductor laser as a light source and illuminates the photosensitive member to lower the surface potential at an exposed part to +50 volts, thereby forming a latent image on the photosensitive member.

More specifically, laser light emitted from the laser is processed through an optical system including a collimator lens, a polygonal scanner, an f-θ lens, a reflecting mirror and a dust-protection glass to provide the image light 12 which is then caused to illuminate the photosensitive drum 1 in a focused spot size on the drum which is a little larger than 42.3 $\mu$m that is one pixel size corresponding to the resolution of 600 dpi, whereby an electrostatic latent image having an exposed part potential of ca. +50 volts is formed on the drum 1. The electrostatic latent image is then developed with the toner from the developing apparatus 4 to form a toner image on the drum 1. The toner image is then positively charged with a total current of ca. +100 $\mu$A (AC+DC) from a post charger 10 so as to weaken the adhesion between the photosensitive member and the toner and facilitate the transfer and separation of the toner image from the drum 1. In this embodiment, the development is performed by using a black magnetic mono-component developer which allows a simple and highly durable developing system not requiring a maintenance until the end of the developing sleeve life. The toner used as a positively chargeable toner having a weight-average particle size of 8.0 $\mu$m. When the toner in the vicinity of the sensor 44 (in FIG. 4) is absent due to continual use, the detector 44 detects the absence to output a piezoelectric signal for rotating a magnet roller 9*a* thereby replenishing a fresh toner from a hopper 9 into the developing apparatus 4. The toner image formed on the drum 1 and having passed by the post charger 10 is then transferred onto a transfer material P moved in a direction indicated by an arcuate arrow under the action of a transfer charger 5. The toner image on the transfer material P is then sent to a fixing device 7 where the toner image is fixed. A portion of the toner remaining on the drum 1 after the transfer is removed from the drum 1 by a cleaner 6.

In the case of using an a-Si drum 1 as an electrostatic image-bearing member suitable for a high-speed image forming machine, a drum heater is generally installed with the drum 1 so as to prevent the occurrence of image flow at the time of start-up and retain a stable performance while obviating adverse effect of a temperature-dependence of the a-Si photoconductor. If the developing sleeve comprising stainless steel is used in combination with a drum equipped with a drum heater, the developing sleeve is liable to cause a thermal deformation due to a heat from the drum heater and a small thermal conductivity of the stainless steel. For this reason, the developing sleeve may preferably comprise a material, such as aluminum or aluminum alloy, having a large thermal conductivity and less liable to cause a thermal deformation due to a heat from the drum heater. The developing sleeve 43 rotates at a peripheral speed of, e.g., 767.5 mm/s with a gap G1 of, e.g., 220 $\mu$m, from the photosensitive drum 1. The development is performed under application of a developing bias voltage to the developing sleeve 43. An example of the developing bias voltage suitably applied to the developing sleeve 43 is an AC/DC superposed voltage comprising an AC voltage having a peak-to-peak voltage (Vpp) of 1.0 kV, a frequency of 2.7 kHz and a duty ratio of 35% superposed with a DC voltage (Vdc) of 280 volts.

An example of toner suitably used in this embodiment is a magnetic toner comprising magnetic toner particles each containing magnetic fine particles dispersed in a resin.

The toner may have a volume-average particle size of 4–10 $\mu$m, preferably 6–8 $\mu$m. Below 4 $\mu$m, the toner control becomes difficult, and particularly the solid black image portion is liable to exhibit a lower density. Above 10 $\mu$m, the resolution of thin line image is liable to be inferior. In a specific example, a toner having a volume-average particle size of 7 $\mu$m was used.

Particle size distribution of toner particles may be measured according to various methods.

The values described herein are based on measurement using a Coulter Counter TA-II (available from Coulter Electronics, Inc.). For measurement, several mg of a sample toner is dispersed in an electrolytic solution formed by adding several drops of a surfactant to a 1%-NaCl aqueous solution, and subjecting the mixture to ultrasonic dispersion for several minutes. The resultant sample dispersion is subjected to a particle size distribution measurement in a particle size range of 2–40 $\mu$m through an aperture of 100 $\mu$m. For the specific toner having a volume-average particle size of 7 $\mu$m, a fine powder fraction of 4 $\mu$m or smaller was suppressed to 20% or less by number, and a coarse powder fraction of 15 $\mu$m or larger was suppressed to 5% or less by volume.

The toner binder may generally comprise a styrene-based polymer, such as a styrene-acrylate copolymer or a styrene-butadiene copolymer, a phenolic resin or a polyester resin. In a specific example, a 8:2 (by weight) mixture of a styrene-acrylate copolymer and a styrene-butadiene copolymer was used.

A charge-control agent may generally be added internally to the toner particles but can also be externally blended with the toner particles. Suitable examples thereof for providing positively chargeable toners may include: nigrosine, quaternary ammonium compounds, triphenylmethane compounds and imidazole compounds. In a specific example, a triphenylmethane compound was added in an amount of 2 wt. parts per 100 wt. parts of the binder resin.

Further, paraffin wax was added as a wax component and magnetite particles were added as magnetic particles to provide toner particles, to which silica was externally added to provide a positively chargeable toner.

Next, several examples for production of developing sleeves are described.

EXAMPLE 1

(Blasting)

An Al sleeve of 32.3 mm in outer diameter and 0.65 mm in thickness was subjected to surface-blasting with 600 mesh-spherical glass beads in the following manner.

More specifically, against the sleeve rotating at 36 rpm, the glass beads were blown through 4 nozzles of each 7 mm in diameter and disposed at a distance of 150 mm in 4 directions around the sleeve at a blasting pressure of 2.5 kg/cm$^2$ for 9 sec. (totally: 36 sec). After the blasting, the blasted sleeve surface was washed and dried to have surface roughnesses Ra of 0.6 $\mu$m and Rz of 4 $\mu$m.

(Plating Pre-treatment)

The blasted Al sleeve was treated with a commercially available zincate agent ("SUMER K-102", available from Nippon Kanizen K.K.) to surface-deposit zinc thereon for improving the adhesion of a Ni—P plating layer to be formed on the Al sleeve surface.

(Ni—P plating)

The above-treated Al sleeve was immersed in a commercially available Ni—P electroless plating liquid ("S-754", available from Nippon Kanizen K.K.) for 100 min. of electroless plating at 90° C., thereby forming a 19 $\mu$m-thick Ni—P (P content=10.3 wt. %) electroless plating layer.

(Cu Plating)

The Ni—P-plated sleeve was immersed in a plating bath containing 0.1 mol/l of copper sulfate (as a soluble copper salt), 0.3 ml/l of ethylene-diamine (as a complexing agent for forming a copper complex) and 30 g/l of a surfactant ("NONION NS230", made by Nippon Yushi K.K.; for preventing pitting and providing a smooth plating film having a good appearance). The Cu-plating was performed at a bath temperature of ca. 30° C. at a cathode current density of 5 A/dm$^2$ to form a 1 $\mu$m-thick Cu-plating layer as a joint layer.

(Cr Plating)

The Cu-plated sleeve was then immersed in a commercially available Cr plating liquid (aqueous chromatic acid solution) for 15 min. of electroplating at 45° C. and a current density of 15 A/dm$^2$ to form a 1 $\mu$m-thick Cr-plating layer.

The thus Cr-plated sleeve exhibited a coercive force of 40 oersted and a saturation magnetic flux of 60 Gauss.

Further, the Cr-plated sleeve exhibited a hardness Hv of 605–640, and surface roughnesses Ra of 0.53 $\mu$m and Rz of 3.54 $\mu$m.

(Magnet Insertion)

A magnet characterized by the data shown in the above Table 1 was inserted in the above-treated sleeve to provide a developing sleeve.

(Performance Evaluation)

The above-prepared developing sleeve was incorporated in a developing apparatus as described above with reference to FIG. 4 (including a magnetic blade 42 having a tapered tip as described with reference to FIG. 6 and disposed with a gap G2 of 180 μm from the developing sleeve), and the developing apparatus was incorporated in an image forming system described with reference to FIG. 5, to evaluate image forming performances, particularly the tailing suppression performance.

Figure 3A:
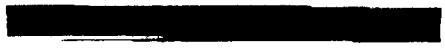
FIGS. 3A and 3B illustrate a phenomenon of trailing ears from a lateral line image.
Figure 3B:
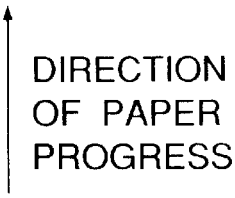
Figure 3B:
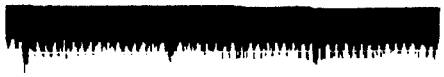

More specifically, for the evaluation, an original having an image-areal percentage of 6% was continually reproduced on both sides each of $10^6$ A4-size sheets laterally fed at a rate of ca. $6\times10^4$ pages/day (including 12 hours of operation each day) in an environment of 23° C./50% RH, and after the continual image formation, a lateral line having a width of 4 dots (as illustrated in FIG. 3A) was reproduced, and the reproduced lateral line image was evaluated with respect to the presence or absence of tailing of images as illustrated in FIG. 3B according to the following standard.

A: Substantially no trailing was recognized with the naked eye but some tailing was recognized when observed through a magnifying glass.

C: Tailing was recognized by naked-eye observation.

D: Remarkable tailing was recognized by noted-eye observation.

The results of evaluation together with some representative features of the developing sleeve (developer-carrying member) and process features are summarized in Table 2 along with those of the following Examples and Comparative Examples.

EXAMPLE 2

A developing sleeve was prepared and evaluated in the same manner as in Example 1 except that the spacing between the magnetic blade 42 and the sleeve 43 was increased from 180 μm to 240 μm.

As a result of the increased gap G2, the toner amount carried on the developing sleeve was slightly increased to lower the toner charge which slightly adversely affected the tailing, but the tailing suppression performance was still better than those of Comparative Examples described hereinafter.

EXAMPLE 3

A developing sleeve was prepared and evaluated in the same manner as in Example 1 except that the magnetic blade 42 was changed to one having a rectangular cross-section as shown in FIG. 7 represented by equal thicknesses of t1=1 mm and t2=1 mm.

As a result of the use of such a rectangular (taper-less) magnetic blade 42, the toner amount carried on the developing sleeve was slightly increased because of a lower toner regulating force to lower the toner charge which slightly adversely affected the tailing, but the tailing suppression performance was still better than those of Comparative Examples described hereinafter.

EXAMPLE 4

A developing sleeve was prepared and evaluated in the same manner as in Example 1 except that the joint layer was formed by electroplating of aluminum by using a plating both containing $AlCl_3$ and 1-methyl-3-propylimidazolium bromide in a mol ratio of 2:1 and containing 4 gl of polystyrene under stirring. Before the plating, the sleeve was subjected to pre-treatment including: degreasing with an alkali, electrolytic washing, acid washing, water washing and drying. An aluminum sheet was immersed as the anode and the Ni—P-plated sleeve was immersed as the cathode for 2.5 min. in the plating bath held at 50° C. under stirring in a dry nitrogen gas atmosphere to effect aluminum plating at a current density of 1 A/$dm^2$.

EXAMPLE 5

A developing sleeve was prepared and evaluated in the same manner as in Example 1 except that the intermediate layer was formed as a Ni—B electroless plating layer by dipping the zincated aluminum sleeve in a nickel-boron plating bath of pH 6.5 containing dimethylamineborane (as a reducing agent). The electroless plating was effected at 70° C. to provide a Ni—B layer (B content=1.02 wt. %).

EXAMPLE 6

A developing sleeve was prepared and evaluated in the same manner as in Example 1 except that the intermediate layer was formed as a 19 μm-thick Pd—P electroless plating layer by using a plating bath at pH 7 and 50° C. having the following composition:

| | |
|---|---|
| Palladium chloride | 1.5 g/l |
| Ethylenediamine | 5 g/l |
| Sodium hydrophophite | 7 g/l |
| Thioglycolic acid | 0.03 g/l |

EXAMPLE 7

A developing sleeve was prepared and evaluated in the same manner as in Example 1 except that the surfacemost electroplating layer was a 1.5 μm-thick principally Pd-electroplating layer by electroplating for 20 sec. at a current density of 2 A/$dm^2$ in a Pd-plating bath at pH 7 and 50° C. under stirring having the following composition:

| | |
|---|---|
| Dichlorotetraamine-palladium | 4 g/l |
| Pyridine-3-sulfonic acid | 5 g/l |
| Thallium nitrate | 27 ppm |
| Ammonium nitrate | 400 g/l |
| Ammonium chloride | 107 g/l |

Comparative Examples 1–6

A developing sleeve was prepared in the same manner as in Example 1 except that a 1 μm-thick Ni electroplating layer instead of the Cu electroplating layer was formed by immersing the Ni—P plated Al sleeve in an Ni-plating liquid (sulfuric acid-acidified nickel sulfate aqueous) for electroplating.

In this way, 6 identical developing sleeves were prepared and respectively evaluated in the same manner as in Example 1 at different sleeve peripheral speeds of 787.5 mm/se (in Comparative Example 1, the same speed as in Example) to 465.0 mm/sec (in Comparative Example 6) corresponding to image forming speeds of 85 A4-size sheets to 52 A4-size sheets/min.

As a result, as shown in Table 2, the tailing of images was not recognized at a lower developing sleeve speed (i.e., a low image forming speed as in Comparative Example 6) but was remarkably observed at a higher developing sleeve speed (as in Comparative Example 1). This is presumably because the magnetic field in the developing region was disturbed due to a substantial magnetic property of the plating layers constituting the developing sleeve, whereby the toner ears in a substantial length on the developing sleeve were entangled with each other to be transferred as such onto the image-bearing member.

Instead thereof, the use of a substantially non-magnetic Cu or Al joint layer in Examples 1–7 instead of the ferromagnetic Ni joint layer used in Comparative Examples effectively suppressed the entire magnetization of the plating layers including a surfacemost rigid electroplating layer exhibiting a good wear resistance, thereby effectively suppressing the occurrence of tailing of images.

TABLE 2

| | Developer-carrying member (sleeve 43) | | | | | | | Magnetic blade (42) | | Tailing |
|---|---|---|---|---|---|---|---|---|---|---|
| | Plating layers * | | | | | | | | | |
| Example | Surface electroplating layer | Joint layer (P3) | Intermediate layer (P1) | Substrate (S) | Roughness Ra (μm) | Surface speed (mm/s) | Process speed (sheets/min) | $t_1/t_2$ (mm) | gap G2 from sleeve (μm) | after durability test |
| 1 | Cr | Ep Cu | ELP Ni-P | Al alloy | 0.52 | 787.5 | 85 | 1.6/0.3 | 180 | A |
| 2 | ↑ | ↑ | ↑ | ↑ | 0.52 | 787.5 | 85 | 1.6/0.3 | 240 | B |
| 3 | ↑ | ↑ | ↑ | ↑ | 0.52 | 787.5 | 85 | 1/1 | 180 | B |
| 4 | ↑ | Ep Al | ↑ | ↑ | 0.52 | 787.5 | 85 | 1.6/0.3 | 180 | B |
| 5 | ↑ | Ep Cu | ELP Ni-B | ↑ | 0.52 | 787.5 | 85 | 1.6/0.3 | 180 | B |
| 6 | ↑ | ↑ | ELP Pd-P | ↑ | 0.52 | 787.5 | 85 | 1.6/0.3 | 180 | B |
| 7 | Pd | ↑ | ELP Ni-P | ↑ | 0.52 | 787.5 | 85 | 1.6/0.3 | 180 | B |
| Comp. 1 | Cr | Ep Ni | ELP Ni-P | ↑ | 0.55 | 787.5 | 85 | 1.6/0.3 | 180 | D |
| Comp. 2 | ↑ | ↑ | ↑ | ↑ | 0.55 | 708.8 | 77 | 1.6/0.3 | 180 | D |
| Comp. 3 | ↑ | ↑ | ↑ | ↑ | 0.55 | 637.9 | 69 | 1.6/0.3 | 180 | C |
| Comp. 4 | ↑ | ↑ | ↑ | ↑ | 0.55 | 574.1 | 63 | 1.6/0.3 | 180 | B |
| Comp. 5 | ↑ | ↑ | ↑ | ↑ | 0.55 | 516.7 | 57 | 1.6/0.3 | 180 | B |
| Comp. 6 | ↑ | ↑ | ↑ | ↑ | 0.55 | 465.0 | 52 | 1.6/0.3 | 180 | A |

*: "EP" represents electro-plating
"ELP" represents electroless plating

What is claimed is:

1. A developer-carrying member for carrying and conveying thereon a developer, having a laminate structure including successively a substrate having a surface roughness, an intermediate layer having a surface roughness smaller than the surface roughness of the substrate, a joint layer, and an electroplating layer, wherein the joint layer comprises a material having a susceptibility of at most 1 CGS.

2. A developer-carrying member according to claim 1, wherein the surface roughness of the substrate as represented by a ten point-average roughness Rz is in a range of 1–8 μm or an arithmetic average roughness Ra of 0.1–1.2 μm.

3. A developer-carrying member according to claim 1, wherein the substrate comprises a material selected from a group consisting of aluminum, an aluminum alloy, and a copper alloy, and having a Vickers hardness in a range of 40–180.

4. A developer-carrying member according to claim 1, wherein the intermediate layer has a thickness in a range of 3–30 μm.

5. A developer-carrying member according to claim 1, wherein the intermediate layer is an Ni—P electroless plating layer.

6. A developer-carrying member according to claim 1, wherein the electroplating layer has a thickness in a range of 0.2–5 μm.

7. A developer-carrying member according to claim 1, wherein the electroplating layer has a thickness smaller than a thickness of the intermediate layer.

8. A developer-carrying member according to claim 1, wherein the joint layer comprises a Cu plating layer and an Al plating layer.

9. A developer-carrying member according to claim 1, wherein the joint layer has a thickness in a range of 0.2–2 μm.

10. A developer-carrying member according to claim 1, wherein the electroplating layer comprises a Cr plating layer.

11. A developer-carrying member according to claim 1, wherein the intermediate layer comprises an Ni—P electroless plating layer, and wherein the electroplating layer comprises a Cr plating layer.

12. A developer-carrying member according to claim 11, wherein the joint layer comprises a Cu plating layer.

13. A developing apparatus for developing an electrostatic latent image formed on an image-bearing member, the developing apparatus comprising a developer-carrying member which has a laminate structure including successively a substrate having a surface roughness, an intermediate layer having a surface roughness smaller than that of the substrate, a joint layer, and an electroplating layer, wherein the joint layer comprises a material having a susceptibility of at most 1 CGS.

14. A developing apparatus according to claim 13, wherein the substrate of the developer-carrying member comprises a hollow cylindrical substrate, within which a magnetic field generating means is disposed.

15. An image forming apparatus, comprising:

an image-bearing member for forming an electrostatic image thereon, and a developer-carrying member disposed opposite to the image-bearing member for carrying and conveying a developer thereon to develop the electrostatic image, wherein the developer-carrying member has a laminate structure including successively a substrate having a surface roughness, an intermediate layer having a surface roughness smaller than the surface roughness of the substrate, a joint layer, and an electroplating layer, and wherein the joint layer comprises a material having a susceptibility of at most 1 CGS.

16. An image forming apparatus apparatus according to claim 15, wherein the substrate of the developer-carrying member comprises a hollow cylindrical substrate, within which a magnetic field generating means is disposed.

17. An image forming apparatus according to claim 16, wherein the developer-carrying member is driven at a peripheral speed of at least 570 mm/sec.

18. An image forming apparatus according to claim 15, wherein the electrostatic image-bearing member has a photosensitive layer principally comprising amorphous silicon.

19. A developer-carrying member for carrying and conveying thereon a developer, having a laminate structure including successively a substrate having a surface roughness, an intermediate layer having a surface roughness smaller than the surface roughness of the substrate, a joint layer, and an electroplating layer, wherein the joint layer comprises a plating layer selected from a group consisting of a Cu plating layer and an Al plating layer.

20. A developing apparatus for developing an electrostatic latent image formed on an image-bearing member, the developing apparatus comprising a developer-carrying member which has a laminate structue including successively a substrate having a surface roughness, an intermediate layer having a surface roughness smaller than the surface roughness of the substrate, a joint layer, and an electroplating layer, wherein the joint layer comprises a plating layer selected from a group consisting of a Cu plating layer and an Al plating layer.

21. An image forming apparatus, comprising:

an image-bearing member for forming an electrostatic image thereon, and a developer-carrying member disposed opposite to the image-bearing member for carrying and conveying a developer thereon to develop the electrostatic image, wherein the developer-carrying member has a laminate structure including successively a substrate having a surface roughness, an intermediate layer having a surface roughness smaller than the surface roughness of the substrate, a joint layer, and an electroplating layer, and wherein the joint layer comprises a plating layer selected from a group consisting of a Cu plating layer and an Al plating layer.

* * * * *

UNITED STATES PATENT AND TRADEMARK OFFICE

CERTIFICATE OF CORRECTION

PATENT NO. : 6,795,675 B2
DATED : September 21, 2004
INVENTOR(S) : Hideki Fujita It is certified that error appears in the above-identified patent and that said Letters Patent is hereby corrected as shown below:

Column 2,
Line 33, “volume” should be deleted; and
Line 49, “thereon” should be deleted.

Column 3,
Line 23, “trailing” should read -- tailing --.

Column 4,
Line 39, “metal” should read -- metals --; and
Line 67, “volume” should be deleted.

Column 7,
Line 65, “a 8:2” should read -- an 8:2 --.

Column 9,
Line 9, “image-areal” should read -- image-area --;
Line 18, “trailing” should read -- tailing --; and
Line 62, “4 gl” should read -- 4g/l --.

Column 11,
Line 66, “comprises” should read -- comprises one of --.

Column 12,
Line 41, “than that” should read -- than the surface roughness --; and
Line 64, “apparatus apparatus” should read -- apparatus --.

UNITED STATES PATENT AND TRADEMARK OFFICE

CERTIFICATE OF CORRECTION

PATENT NO. : 6,795,675 B2
DATED : September 21, 2004
INVENTOR(S) : Hideki Fujita It is certified that error appears in the above-identified patent and that said Letters Patent is hereby corrected as shown below:

Column 13,
Line 2, “is” should read -- rotatively --; and
Line 19, “structue” should read -- structure --.

Signed and Sealed this

Twenty-eighth Day of December, 2004

JON W. DUDAS
*Director of the United States Patent and Trademark Office*